US005267705A

United States Patent [19]

Hofrichter et al.

[11] Patent Number: 5,267,705

[45] Date of Patent: Dec. 7, 1993

[54] APPARATUS FOR STORING AND UNWINDING WIRE ROLLS

[76] Inventors: Peter Hofrichter; John C. Hofrichter, both of R.D. #3, Box 49, McDonald, Pa. 15057

[21] Appl. No.: 992,419

[22] Filed: Dec. 17, 1992

[51] Int. Cl.[5] ..... B65H 69/18; B65H 49/24

[52] U.S. Cl. ..... 242/129; 242/129.62; 242/137.1; 242/156

[58] Field of Search ..... 242/129, 129.5, 129.7, 242/129.72, 129.8, 130, 132, 134, 137, 137.1, 138, 141, 146, 159, 170, 171; 206/408

[56] References Cited

U.S. PATENT DOCUMENTS

| | | | |
|---|---|---|---|
| 2,501,201 | 3/1950 | Wilcox | 242/129 X |
| 2,512,324 | 6/1950 | Hall | 242/129 |
| 2,542,882 | 2/1951 | Shumway | 242/137.1 |
| 3,125,312 | 3/1964 | McDuffie | 242/129 |
| 3,134,558 | 5/1964 | McDuffie | 242/129 |
| 3,150,769 | 9/1964 | Cohn | 242/137 |
| 3,172,617 | 3/1965 | Johnson | 242/129.5 |
| 3,729,092 | 4/1973 | Marcell | 242/129 |
| 3,982,712 | 9/1976 | Bassett | 242/129 |
| 4,422,596 | 12/1983 | Cleavenger | 242/129 |
| 4,685,633 | 8/1987 | Pellini | 242/129.6 |
| 4,786,213 | 11/1988 | Leppänen | 242/129 |
| 4,826,100 | 5/1989 | Belliveau | 242/129 |

*Primary Examiner*—Stanley N. Gilreath

[57] ABSTRACT

An apparatus for storing and unwinding wire rolls containing electrical conductors that are not wound on a reel but form coils by their own semi-rigid structure. The apparatus is a rigid container formed by a first side panel spaced from a second side panel by a series of rotatable rollers that form a U-shaped configuration to accept and facilitate the unwinding of a roll of wire through the open top of the apparatus. Two opposing face panels attached to the vertical edges of the side panels and a base panel complete the basic container structure. A spring loaded interior panel located between, and parallel to, the first and second side panels provides necessary horizontal force to hold a roll of wire in a vertical position while the rollers support the wire roll from below. Carrying handles in the side panels are provided for transporting the device while a similar handle on the interior panel allows the user to manually move the panel for loading or unloading wire rolls.

4 Claims, 5 Drawing Sheets

APPARATUS FOR STORING AND UNWINDING WIRE ROLLS

BACKGROUND OF INVENTION

This apparatus relates to a method for unwinding coils of wire containing electrical conductors in a smooth, non-twisting fashion while providing convenient transport and storage.

As is widely known, electrical conductors and other similar products in general are usually wound around themselves forming conventional rolls. The wire is flexible yet has stability in itself. It specifically includes commercial and residential conductor generally referred to as "ROMEX".

"ROMEX" has a tendency to kink as it comes off a roll which provides problems to those in the installation market. It is generally sold in cardboard boxes which dispense wire out of a center hold cut in the box. The wire becomes twisted as it is pulled out. To avoid twisting, it is common practice to remove the roll from the box and unravel the spool by hand. This eliminates most twisting and kinking but results in cumbersome handling of the roll and the likelihood of unintended uncoiling and twisting.

Another common approach to dispense "ROMEX" involves a rack with a rod through the center of the roll. The roll rotates around the center rod as the wire is pulled. Of the current art mentioned, this is the most efficient way to unwind "ROMEX" but this system generally does not allow easy replacement of the roll and is inconvenient in many circumstances.

The wire unwinding apparatus set forth in this application provides a simple way of dispensing "ROMEX" wire smoothly while allowing for convenient loading, unloading and transport.

DESCRIPTION OF DRAWINGS

The attached drawings illustrate this invention wherein.

DETAILED DESCRIPTION

Figure 1:
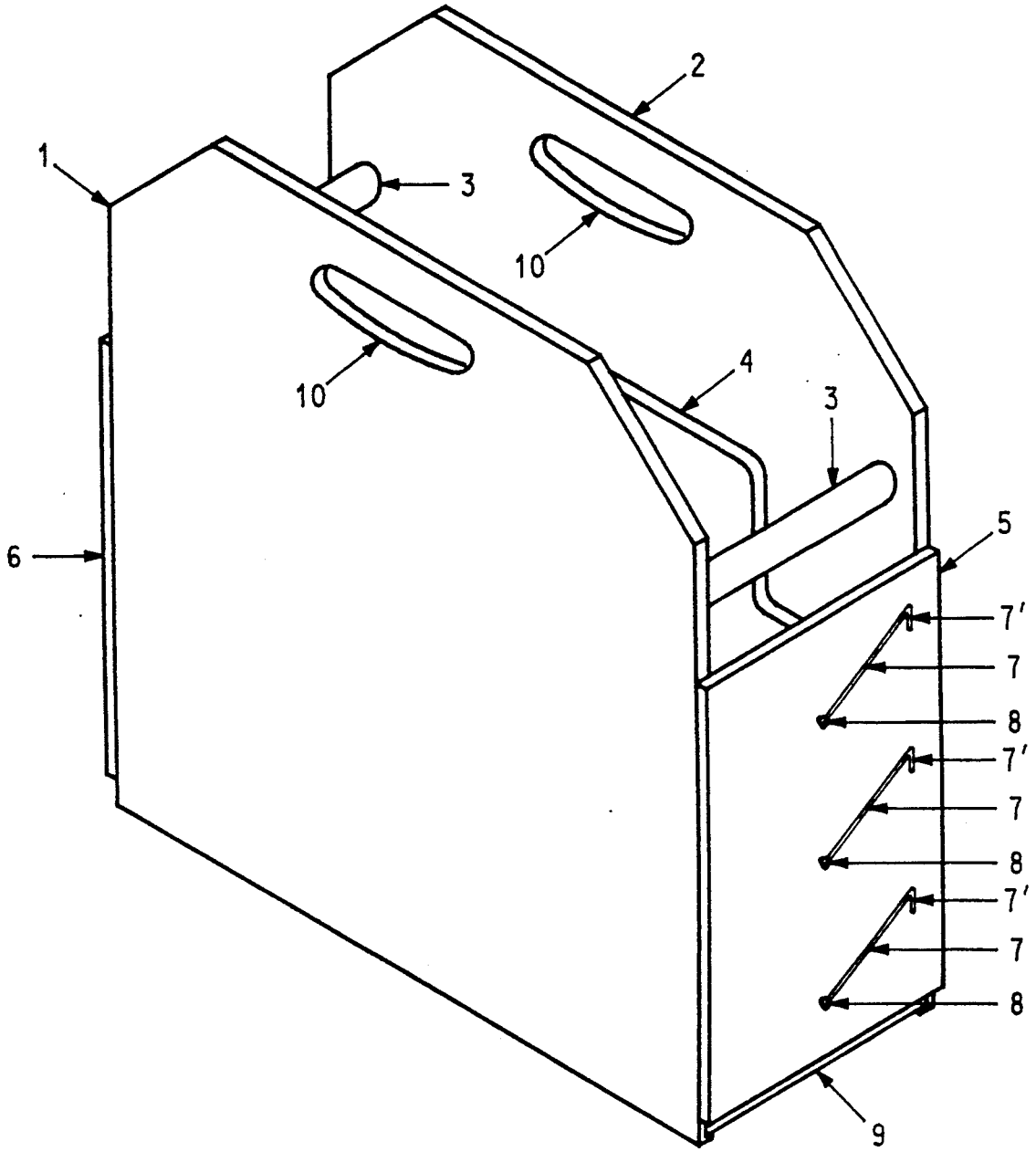
FIG. 1 shows, in perspective, an apparatus for storing and unwinding wire rolls containing electrical conductors.

As illustrated by the drawings, the apparatus for storing and unwinding wire rolls containing electrical conductors is a narrow box container of dimensions only slightly larger than a standard roll of "ROMEX" wire (FIG. 1). The apparatus is comprised of: a first side panel 1 spaced from a second side panel 2 by a series of rotatable rollers 3, a spring-loaded interior panel 4 also positioned between the first and second side panels 1,2, two face panels 5,6 attached to the vertical edges of the first and second side panels 1,2 and a base panel 9 attached to the bottom edges of the first and second side panels 1,2. The two face panels 5,6 are designed with a series of slots 7 that guide the movement of the interior panel 4 by a series of pins 8 attached to the vertical edges of the interior panel 4. Each pin 8 is confined to a corresponding slot 7. Handles 10 for transporting the device are oblong holes cut through the upper portions of the first and second side panels 1,2.

Figure 2:
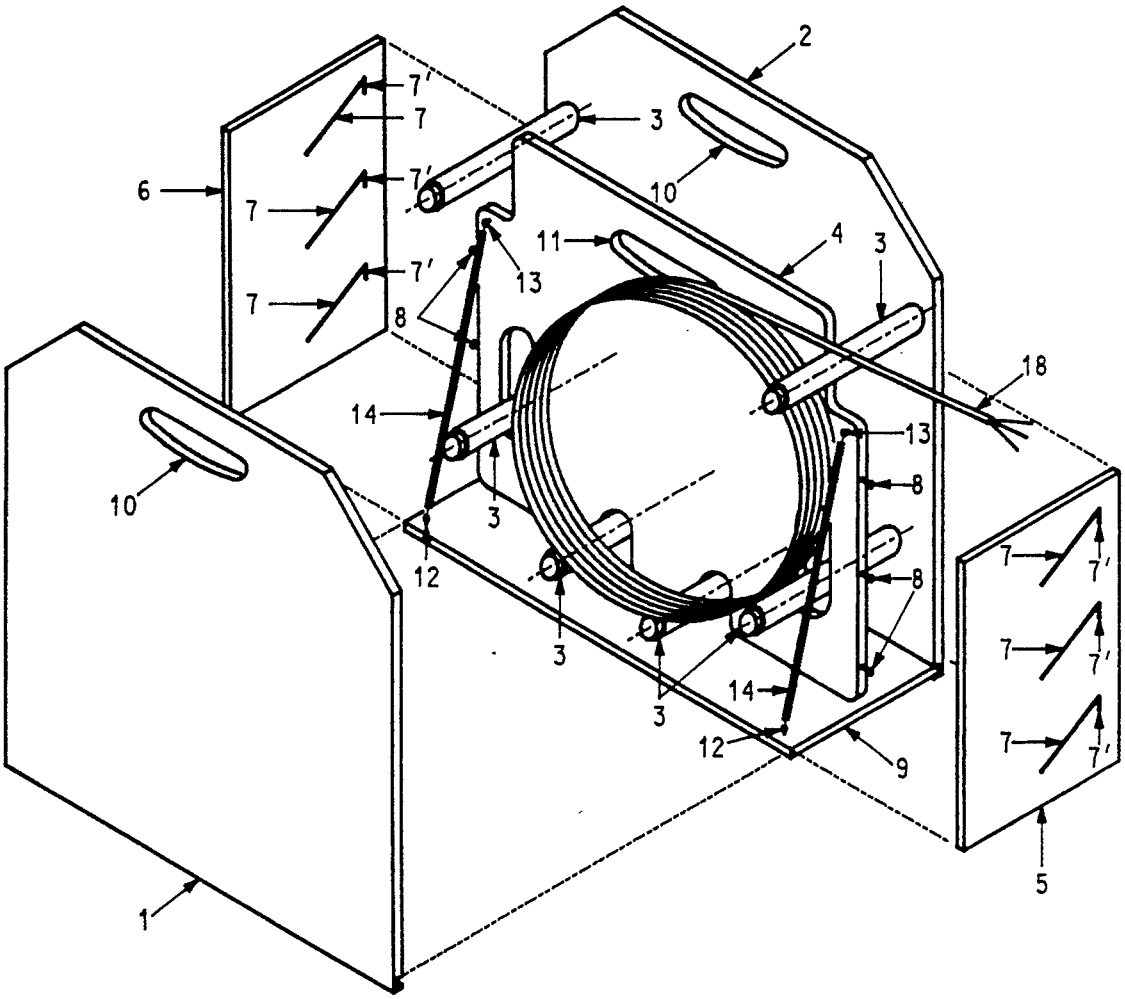
FIG. 2 shows, in perspective, an exploded view of the apparatus with a roll of wire inserted.
Figure 3:
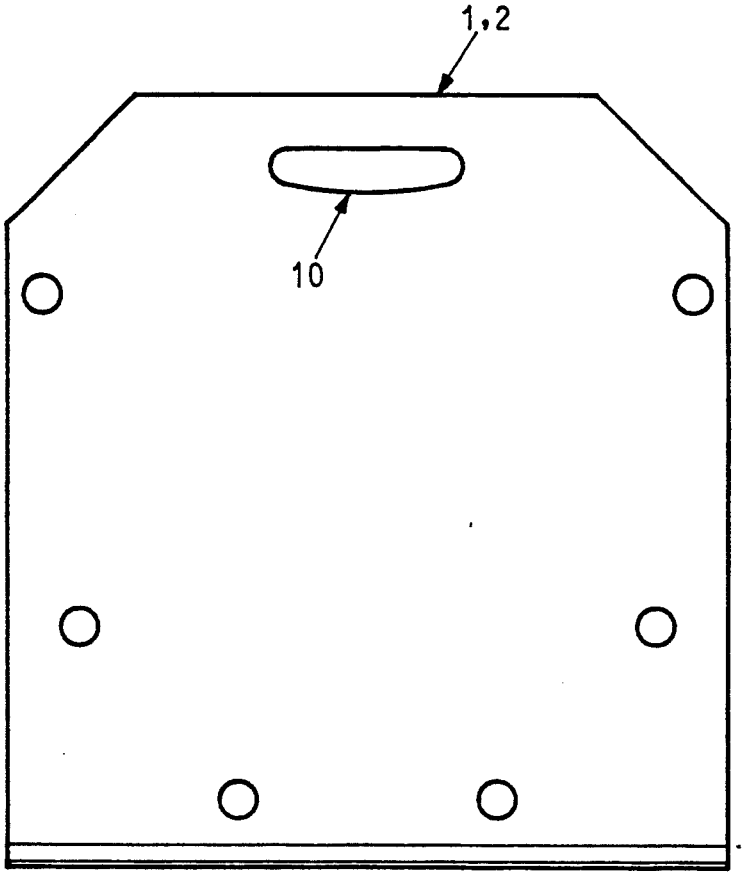
FIG. 3 is an internal front view of a side panel.
Figure 4:
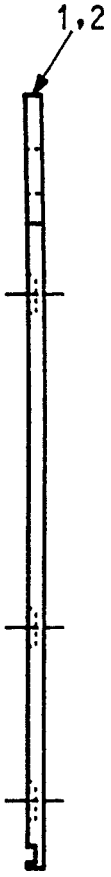
FIG. 4 is a side view of a side panel.
Figure 7A:
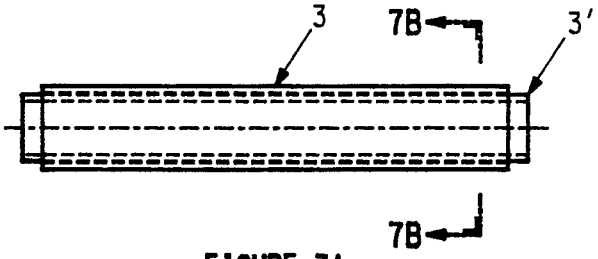
FIG. 7A shows a front view of a roller assembly.
Figure 7B:
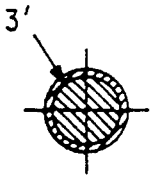
FIG. 7B is a cross-sectional side view of a roller assembly, taken along line 7B—7B indicated in FIG. 7A.

The first side panel 1 (FIG. 3) is a six-edged panel with a handle 10 centered at its upper portion. As is the case with all panels of the device, it is constructed of thin sheet material (FIG. 4) and has an inner surface. The second side panel 2 (FIG. 3) is a mirror image of the first side panel 1 with its inner surface opposing the inner surface of the first side panel 1 (FIG. 2). The two side panels 1,2 are spaced from each other by a series of rollers 3. Each roller 3 has two ends, one end fixed to the inner surface of the first side panel 1 and the other end fixed to the inner surface of the second side panel 2. Each roller 3 (FIG. 7A) is a freely rotating rigid tube that surrounds a fixed solid axle 3' (FIG. 7B). The rollers 3 (FIG. 2) are arranged in a U-shaped configuration to accept a roll of wire from above and allow it to rest on the rollers.

Figure 9:
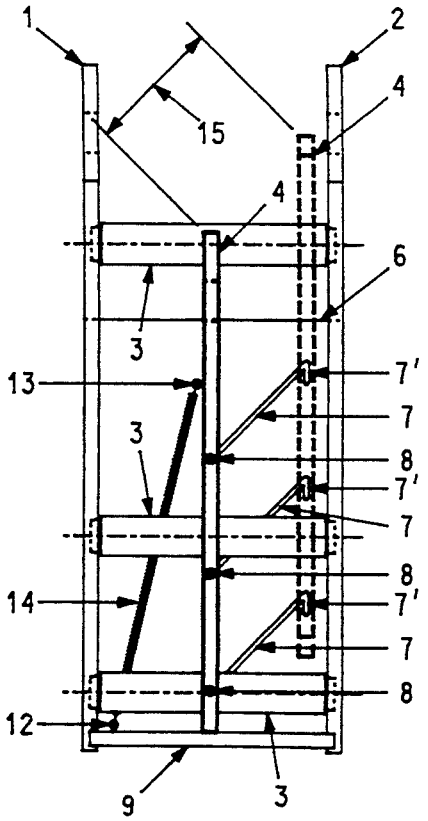
FIG. 9 is a cross-sectional view, taken along the line 9—9 indicated in FIG. 8, that illustrates the diagonal and vertical travel of the interior panel.

The interior panel 4 (FIG. 2) is a panel that is urged by spring force toward the first side panel 1. Centered at the upper portion of the interior panel 4 is a handle 11, similar to the side panel handles 10, that allows the user of the apparatus to manually move the interior panel 4. The interior panel 4 (FIG. 9) always moves in a plane parallel to the first and second side panels 1,2.

Figure 6:
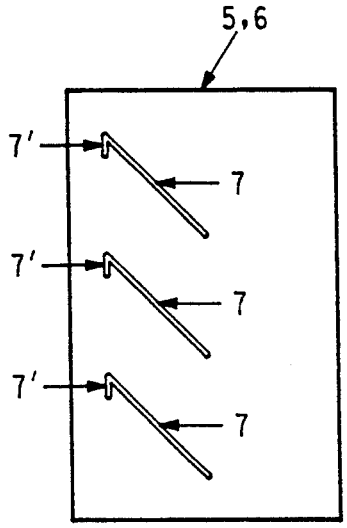
FIG. 6 is a front view of a face panel.

The first face panel 5 (FIG. 2) is a rectangular panel having an inner surface. It is attached at its vertical edges to the vertical edges of the first and second side panels 1,2. The second face panel 6 is a rectangular panel having an inner surface that is attached at its vertical edges to the opposite vertical edges of the first and second side panels 1,2. Each face panels 5,6 (FIG. 6) has a series of diagonal slots 7. The lower end of each slot 7 (FIG. 9) is centered between the first and second side panels 1,2. At the upper end of each slot, near the second side panel 2, is a small vertical drop 7'. A series of pins 8 (FIG. 2) are attached to the vertical edges of the interior panel and extend into the corresponding slots 7 of the first and second face panels 5,6. The pins 8 (FIG. 9) guide the movement of the interior panel 4 along the slots 7 of the face panels 5,6.

Figure 5:
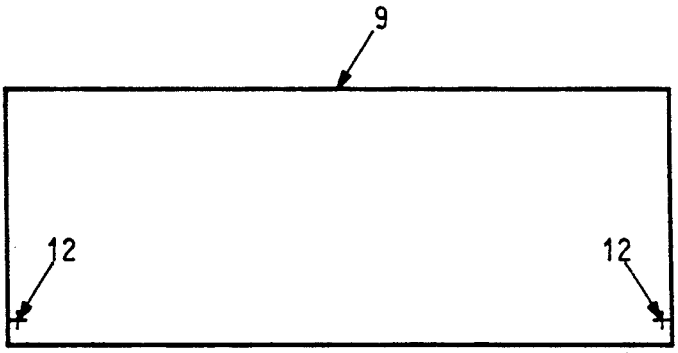
FIG. 5 is a top view of a base panel.

The base panel 9 (FIG. 2) is a rectangular panel attached at its longer edges to the lower edges of the first and second side panels 1,2. Two spring attachment points 12 (FIG. 5) are provided on the base panel 9. Two springs 14 (FIG. 2) are attached to the lower spring attachment points 12 of the base panel and to the upper spring attachment points 13 of the interior panel 4. The springs 14 are attached near each face panel and avoid any contact with the inserted wire roll.

Figure 8:
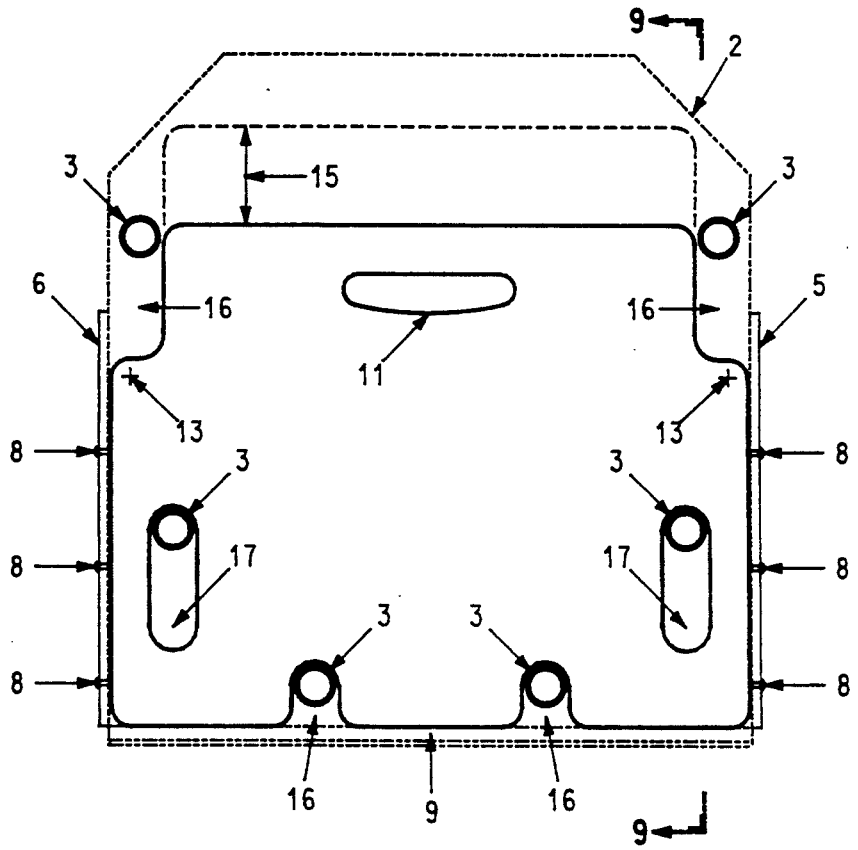
FIG. 8 is a front view of the interior panel with a side panel removed, illustrating the travel of the interior panel.

The springs 14 (FIG. 9) are retracted when in their relaxed state. This state situates the interior panel 4 at the lowest point of the slots 7 and at its closest position to the first side panel 1. When the user manually pulls the interior panel 4 upward, the panel will travel diagonally 15 along the slots 7 to the highest position of the slots 7. This position situates the interior panel 4 at its highest position and closest position to the second side panel 2. The springs 14, now at their most protracted state, exert force toward the first side panel 1. At this point, the interior panel 4 can be "parked" in the vertical drop 7' of the slots 7 which holds the raised interior panel 4 stationary allowing free insertion or removal of wire rolls between the first side panel 1 and the interior panel 4 (FIG. 2). With a roll of wire inserted, the user can again pull upward on the interior panel 4 (FIG. 9), allow the spring force to draw the interior panel 4 down the diagonal slots 7 and exert horizontal force against the wire roll to hold it upright (FIG. 2). The interior panel 4 (FIG. 8) is notched 16 and perforated 17 to prevent the interior panel 4 from coming in contact with the rollers 3 in any position as it moves in a parallel plane to the first and second side panels 1,2.

This design holds a wire roll vertically between the first side panel 1 (FIG. 2) and the interior panel 4 allowing it to rotate smoothly on the rollers as the user manually pulls the wire strand 18 through the open top of the apparatus. The weight of the wire roll provides sufficient downward force to keep the wire roll inside the device and on the rollers 3.

We claim:

1. An apparatus for storing and unwinding wire rolls comprising:

(i) a first side panel having an inner surface and vertical edges;

(ii) a second side panel having an inner surface, bottom portion and vertical edges, the second side panel spaced from the first side panel, the inner surface of the second side panel opposite the inner surface of the first side panel;

(iii) a plurality of rotatable rollers each roller having two ends, one end of each roller joined to the inner surface of the first side panel, the second end joined to the inner surface of the second side panel, the rollers positioned in a U-shaped formation to accept the roll of wire which rests on the rollers;

(iv) an interior panel positioned between the first side panel and second side panel, the interior panel having an upper portion and vertical edges;

(v) two opposing face panels attached to the vertical edges of the first and second side panels, each face panel having a lower end and an upper end and a plurality of diagonal slots extending upwardly from the lower end toward the upper end, the upper end of each slot having a vertical drop;

(vi) a plurality of pins attached to the vertical edges of the interior panel that extend into the corresponding slots of the face panels whereby the movement of the interior panel is guided by the slots;

(vii) a base panel joined to the bottom portion of each side panel; and (viii) a plurality of springs each attached at one end thereof to the upper portion of the interior panel and at the other end thereof to the base panel, the springs urging the interior panel toward the first side panel whereby when a roll of wire is inserted between the interior panel and the first side panel, the roll of wire is kept in an upright position.

2. An apparatus as set forth in claim 1 wherein the plurality of rollers are each further comprised of a fixed axle permanently attached on end to the inner surface of each side panel and a freely rotating tube that surrounds the axle.

3. An apparatus as set forth in claim 1 wherein the interior panel moves in a plane parallel to the first and second side panel.

4. An apparatus as set forth in claim 1 wherein the interior panel is notched and perforated to allow the panel to move between the first and second side panels without coming in contact with any of the rollers when moved vertically and diagonally relative to the first and second side panels.

* * * * *